US012098889B2

(12) United States Patent
Schreiber et al.

(10) Patent No.: US 12,098,889 B2
(45) Date of Patent: Sep. 24, 2024

(54) FALLING FILM HEAT EXCHANGER

(71) Applicants: Johnson Controls Technology Company, Auburn Hills, MI (US); YORK (WUXI) AIR CONDITIONING AND REFRIGERATION CO., LTD., Wuxi (CN)

(72) Inventors: Jeb W. Schreiber, Stewartstown, PA (US); Xiuping Su, Wuxi (CN); Li Wang, Wuxi (CN); Brian Thomas Gallus, York, PA (US); Scott Allen Ford, Spring Grove, PA (US); Fang Xue, Wuxi (CN)

(73) Assignees: Tyco Fire & Security GmbH, Schaffhausen (CH); York (Wuxi) Air Conditioning And Refrigeration Co., Ltd., Jiangsu (CN)

( * ) Notice: Subject to any disclaimer, the term of this patent is extended or adjusted under 35 U.S.C. 154(b) by 0 days.

(21) Appl. No.: 16/757,337

(22) PCT Filed: Oct. 20, 2017

(86) PCT No.: PCT/US2017/057680

§ 371 (c)(1),
(2) Date: Apr. 17, 2020

(87) PCT Pub. No.: WO2019/078893

PCT Pub. Date: Apr. 25, 2019

(65) Prior Publication Data

US 2021/0190432 A1 Jun. 24, 2021

(51) Int. Cl.
*F28D 3/04* (2006.01)
*F25B 39/02* (2006.01)
(Continued)

(52) U.S. Cl.
CPC ..... *F28D 3/04* (2013.01); *F25B 39/028* (2013.01); *F28D 3/02* (2013.01); *F28D 5/02* (2013.01);
(Continued)

(58) Field of Classification Search
CPC ..... F28D 3/02; F28D 3/04; F28D 21/0017; F28F 9/0278; F28F 25/085; F28F 25/087
See application file for complete search history.

(56) References Cited

U.S. PATENT DOCUMENTS 3,502,140 A * 3/1970 Dawson ..... F28D 3/02 165/117
4,764,254 A * 8/1988 Rosenblad ..... F28D 3/04 162/249
(Continued)

FOREIGN PATENT DOCUMENTS

CN 1249032 A 3/2000
CN 2735284 Y 10/2005
(Continued)

OTHER PUBLICATIONS

Machine Translation of JP 2000-241044, Retrieved Jul. 29, 2021 (Year: 2021).*
(Continued)

*Primary Examiner* — Eric S Ruppert
*Assistant Examiner* — Hans R Weiland
(74) *Attorney, Agent, or Firm* — Fletcher Yoder, PC

(57) ABSTRACT

A heat exchanger for a heating, ventilation, air conditioning, and refrigeration (HVAC&R) system includes a shell having an inlet configured to receive refrigerant and an outlet configured to output the refrigerant. The heat exchanger also includes a refrigerant distributor disposed within the shell, and multiple evaporating tubes disposed within the shell and positioned below the refrigerant distributor. The refrigerant
(Continued)

distributor includes a perforated plate having multiple holes, each hole extends from a top surface of the perforated plate to a bottom surface of the perforated plate, and a center point of each hole is substantially aligned with a centerline of a respective evaporating tube.

20 Claims, 9 Drawing Sheets

(51) Int. Cl.

| | |
|---|---|
| ***F28D 3/02*** | (2006.01) |
| ***F28D 5/02*** | (2006.01) |
| ***F28D 21/00*** | (2006.01) |
| ***F28F 9/02*** | (2006.01) |
| ***F28F 25/08*** | (2006.01) |

(52) U.S. Cl.
CPC ..... *F28D 21/0017* (2013.01); *F28F 9/0278* (2013.01); *F28F 25/085* (2013.01); *F28F 25/087* (2013.01)

(56) References Cited

U.S. PATENT DOCUMENTS

| | | | | | |
|---|---|---|---|---|---|
| 5,261,485 | A * | 11/1993 | Thornton | F28F 9/0278 | 165/115 |
| 6,253,571 | B1 * | 7/2001 | Fujii | F28D 3/04 | 62/484 |
| 6,293,112 | B1 * | 9/2001 | Moeykens | F28D 3/04 | 62/84 |
| 6,868,695 | B1 * | 3/2005 | Dingel | F28F 9/0278 | 165/115 |
| 2007/0151279 | A1 * | 7/2007 | Liu | F25B 39/02 | 62/310 |
| 2008/0149311 | A1 * | 6/2008 | Liu | F28D 3/02 | 165/115 |
| 2009/0178790 | A1 * | 7/2009 | Schreiber | F28D 3/04 | 165/158 |
| 2012/0175091 | A1 * | 7/2012 | Kreis | F28D 3/04 | 165/157 |
| 2013/0277019 | A1 | 10/2013 | Numata et al. | | |
| 2014/0223936 | A1 * | 8/2014 | Hartfield | F28D 3/02 | 62/115 |
| 2014/0231058 | A1 * | 8/2014 | Nakamura | F28D 3/04 | 165/177 |
| 2014/0366574 | A1 * | 12/2014 | Christians | F28D 3/02 | 62/518 |
| 2016/0146518 | A1 * | 5/2016 | Liu | F28D 3/04 | 62/84 |
| 2017/0241681 | A1 * | 8/2017 | Su | F28D 5/02 | |

FOREIGN PATENT DOCUMENTS

| | | | | |
|---|---|---|---|---|
| CN | 100451496 | C | | 1/2009 |
| CN | 101922888 | A | | 12/2010 |
| CN | 103673420 | A | | 3/2014 |
| CN | 204718194 | U | | 10/2015 |
| CN | 105783347 | A | | 7/2016 |
| CN | 107091545 | A | | 8/2017 |
| JP | 2000-241044 | | * | 9/2000 |
| JP | 2015515601 | A | | 5/2015 |
| WO | 2017160369 | A1 | | 9/2017 |

OTHER PUBLICATIONS

International Search Report and Written Opinion for PCT Application No. PCT/US2017/057680 mailed Aug. 9, 2018, 19 pgs.
Chinese Office Action for CN Application No. 201780095892.X mailed Dec. 3, 2020, 13 pgs.
Japanese Office Action for JP Application No. 2020-522287, dated Jun. 22, 2021, 7 pgs.
Chinese Office Action for CN Application No. 201780095892.X, dated Jul. 14, 2021, 9 pgs.
Korean Office Action for KR Application No. 10-2020-7014318, dated Jul. 28, 2021, 10 pgs.
European Office Action for EP Application No. 22188996.7, dated Aug. 29, 2022, 17 pages.
Korean Office Action for KR Application No. 10-2020-7014318, dated Sep. 23, 2022, 3 pages.
Japanese Office Action for JP Application No. 2020-522287, dated Oct. 27, 2022, 3 pages.

* cited by examiner

FALLING FILM HEAT EXCHANGER

CROSS-REFERENCE TO RELATED APPLICATIONS

This application is a U.S. National Stage Application of PCT International Application No. PCT/US2017/057680, entitled "FALLING FILM HEAT EXCHANGER," filed Oct. 20, 2017, which is hereby incorporated by reference in its entirety for all purposes.

BACKGROUND

This application relates generally to a falling film heat exchanger that may be used in air conditioning and refrigeration applications.

Vapor compression systems utilize a working fluid, typically referred to as a refrigerant that changes phases between vapor, liquid, and combinations thereof in response to being subjected to different temperatures and pressures associated with operation of the vapor compression system. Certain vapor compression systems include a falling film heat exchanger (e.g., evaporator) having a refrigerant distributor configured to distribute the refrigerant to an evaporating tube bundle. For example, certain refrigerant distributors include a perforated plate having holes that enable the refrigerant to flow through the perforated plate to the evaporating tubes. Unfortunately, typical perforated plates may not evenly distribute the refrigerant to the evaporating tubes, thereby reducing the efficiency of the vapor compression system.

SUMMARY

In an embodiment of the present disclosure, a heat exchanger for a heating, ventilation, air conditioning, and refrigeration (HVAC&R) system includes a shell having an inlet configured to receive refrigerant and an outlet configured to output the refrigerant. The heat exchanger also includes a refrigerant distributor disposed within the shell, and multiple evaporating tubes disposed within the shell and positioned below the refrigerant distributor. The refrigerant distributor includes a perforated plate having multiple holes, each hole extends from a top surface of the perforated plate to a bottom surface of the perforated plate, and a center point of each hole is substantially aligned with a centerline of a respective evaporating tube.

In another embodiment of the present disclosure, a heat exchanger for an HVAC&R system includes a shell having an inlet configured to receive refrigerant and an outlet configured to output the refrigerant. The heat exchanger also includes a refrigerant distributor disposed within the shell, and multiple evaporating tubes disposed within the shell and positioned below the refrigerant distributor. The refrigerant distributor includes a perforated plate having multiple holes each extending substantially along a vertical axis, each hole extends from a top surface of the perforated plate to a bottom surface of the perforated plate, and a first portion of the top surface is positioned above a second portion of the top surface along the vertical axis.

In a further embodiment of the present disclosure, a heat exchanger for an HVAC&R system includes a shell having an inlet configured to receive refrigerant and an outlet configured to output the refrigerant. The heat exchanger also includes a refrigerant distributor disposed within the shell, and multiple evaporating tubes disposed within the shell and positioned below the refrigerant distributor. Each evaporating tube extends along a longitudinal axis, the refrigerant distributor includes a perforated plate having multiple holes, each hole extends from a top surface of the perforated plate to a bottom surface of the perforated plate, and the holes are arranged in at least one row. In addition, spacings between adjacent holes of the at least one row vary along the longitudinal axis, and/or sizes of adjacent holes of the at least one row vary along the longitudinal axis.

In another embodiment of the present disclosure, a heat exchanger for an HVAC&R system includes a shell having an inlet configured to receive refrigerant and an outlet configured to output the refrigerant. The heat exchanger also includes a refrigerant distributor disposed within the shell, and multiple evaporating tubes disposed within the shell and positioned below the refrigerant distributor. Each evaporating tube extends along a longitudinal axis. In addition, the heat exchanger includes a spray header disposed within the shell and positioned above the refrigerant distributor. The spray header has multiple openings configured to output the refrigerant toward the refrigerant distributor, and the openings are arranged along a lateral axis, substantially perpendicular to the longitudinal axis.

DETAILED DESCRIPTION

Figure 1:
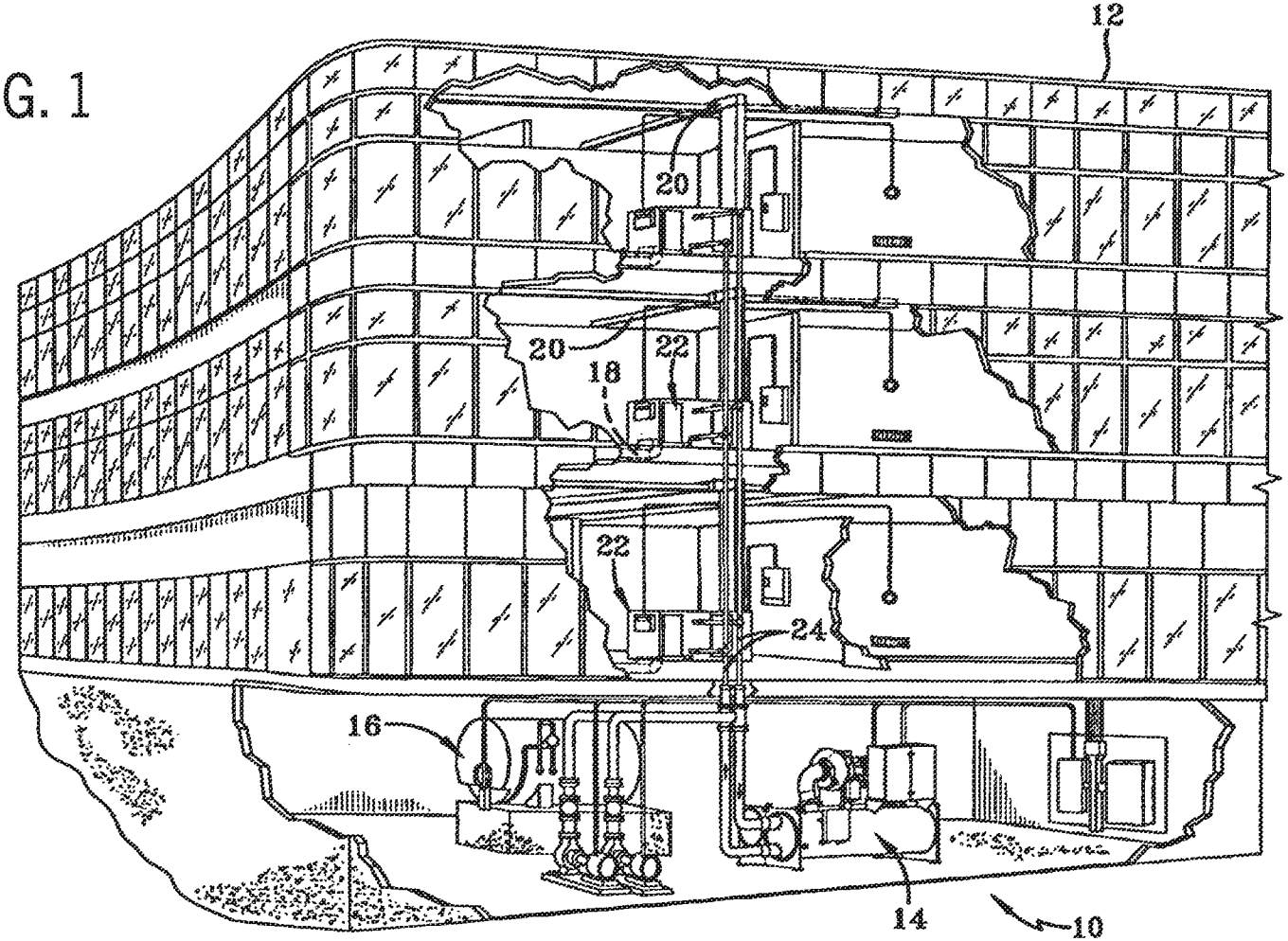
FIG. 1 is a perspective view of an embodiment of a building that may utilize a heating, ventilation, air conditioning, and refrigeration (HVAC&R) system in a commercial setting, in accordance with an aspect of the present disclosure.

Turning now to the drawings, FIG. 1 is a perspective view of an embodiment of a building 12 that may utilize a heating, ventilation, air conditioning, and refrigeration (HVAC&R)

system 10 in a commercial setting. The HVAC&R system 10 may include a vapor compression system 14 that supplies a chilled liquid, which may be used to cool the building 12. The HVAC&R system 10 may also include a boiler 16 to supply warm liquid to heat the building 12 and an air distribution system which circulates air through the building 12. The air distribution system may include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the HVAC&R system 10. The HVAC&R system 10 is shown with a separate air handler on each floor of building 12, but in other embodiments, the HVAC&R system 10 may include air handlers 22 and/or other components that may be shared between or among floors.

Figure 2:
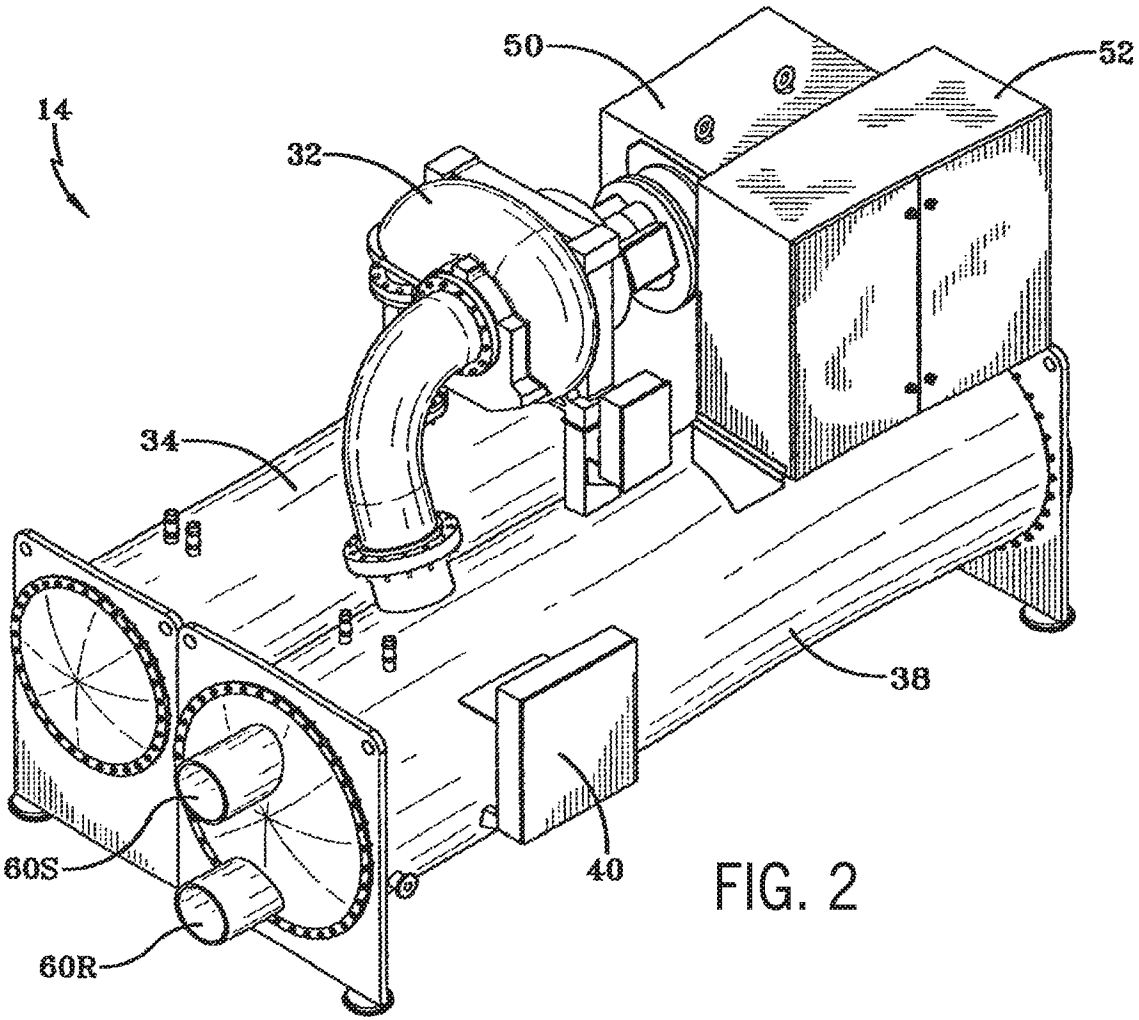
FIG. 2 is a perspective view of an embodiment of a vapor compression system that may be used in the HVAC&R system of FIG. 1.
Figure 3:
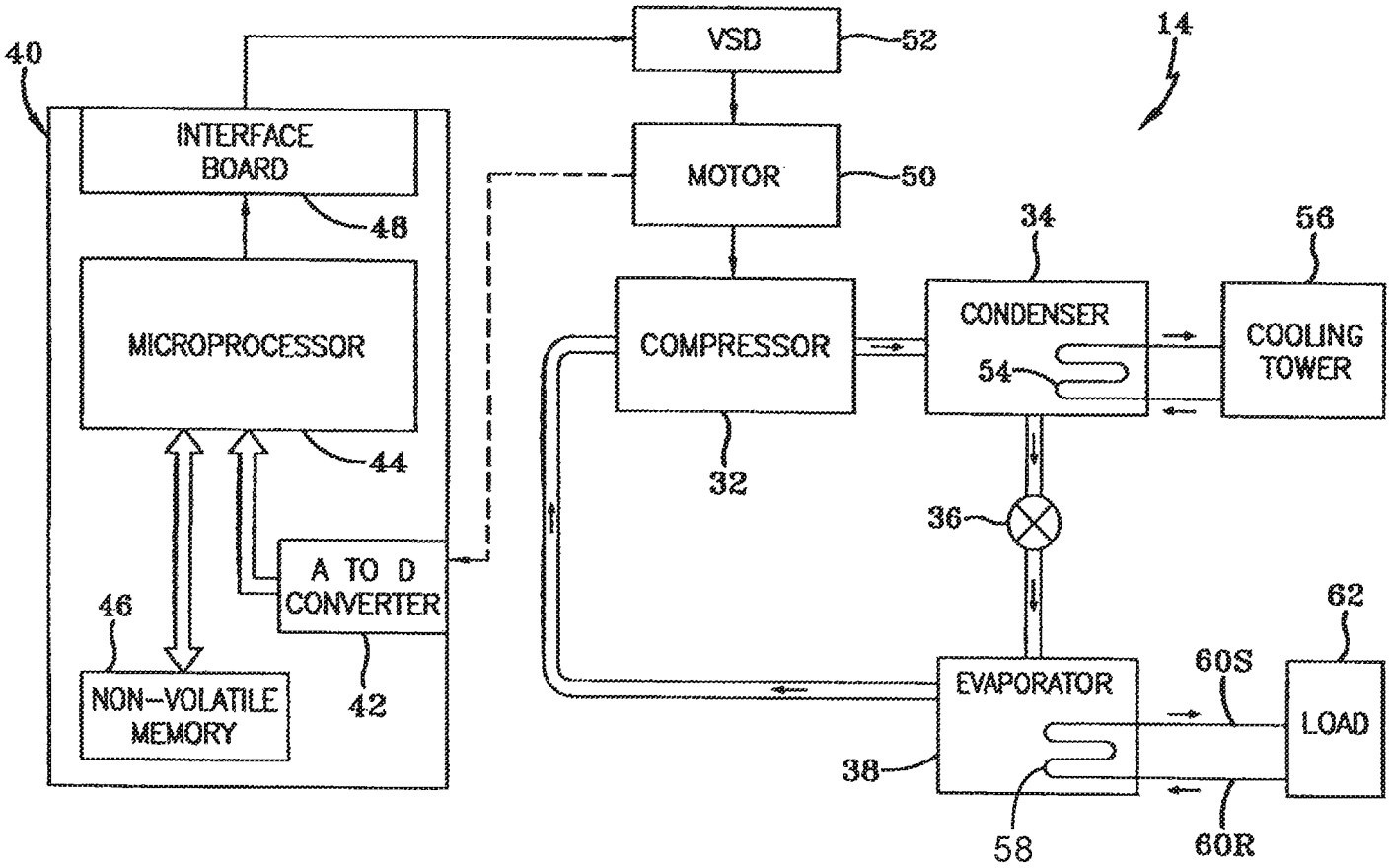
FIG. 3 is a schematic diagram of an embodiment of a vapor compression system that may be used in the HVAC&R system of FIG. 1.

FIG. 2 is a perspective view of an embodiment of a vapor compression system 14 that may be used in the HVAC&R system of FIG. 1, and FIG. 3 is a schematic diagram of an embodiment of a vapor compression system 14 that may be used in the HVAC&R system of FIG. 1. The vapor compression system 14 of FIGS. 2 and 3 may circulate a refrigerant through a circuit starting with a compressor 32. The circuit may also include a condenser 34, expansion valve(s) or device(s) 36, and a liquid chiller or an evaporator 38. The vapor compression system 14 may further include a control system 40 that has an analog to digital (A/D) converter 42, a microprocessor 44, a non-volatile memory 46, and/or an interface board 48.

Some examples of fluids that may be used as refrigerants in the vapor compression system 14 are hydrofluorocarbon (HFC) based refrigerants, for example, R-410A, R-407, R-134a, hydrofluoro olefin (HFO), "natural" refrigerants (e.g., ammonia ($NH_3$), R-717, carbon dioxide ($CO_2$), R-744, or hydrocarbon based refrigerants), water vapor, or any other suitable refrigerant. In some embodiments, the vapor compression system 14 may be configured to efficiently utilize refrigerants having a normal boiling point of about 19 degrees Celsius (66 degrees Fahrenheit) at one atmosphere of pressure, also referred to as low pressure refrigerants, versus a medium pressure refrigerant, such as R-134a. As used herein, "normal boiling point" may refer to a boiling point temperature measured at one atmosphere of pressure.

In some embodiments, the vapor compression system 14 may use one or more of a variable speed drive (VSD) 52, a motor 50, the compressor 32, the condenser 34, the expansion valve or device 36, and/or the evaporator 38. The motor 50 may drive the compressor 32 and may be powered by a variable speed drive (VSD) 52. The VSD 52 receives alternating current (AC) power having a particular fixed line voltage and fixed line frequency from an AC power source, and provides power having a variable voltage and frequency to the motor 50. In other embodiments, the motor 50 may be powered directly from an AC or direct current (DC) power source. The motor 50 may include any type of electric motor that can be powered by a VSD or directly from an AC or DC power source, such as a switched reluctance motor, an induction motor, an electronically commutated permanent magnet motor, or another suitable motor.

The compressor 32 compresses a refrigerant vapor and delivers the vapor to the condenser 34 through a discharge passage. In some embodiments, the compressor 32 may be a centrifugal compressor. The refrigerant vapor delivered by the compressor 32 to the condenser 34 may transfer heat to a cooling fluid (e.g., water or air) in the condenser 34. The refrigerant vapor may condense to a refrigerant liquid in the condenser 34 as a result of thermal heat transfer with the cooling fluid. The liquid refrigerant from the condenser 34 may flow through the expansion device 36 to the evaporator 38. In the illustrated embodiment of FIG. 3, the condenser 34 is water cooled and includes a tube bundle 54 connected to a cooling tower 56, which supplies the cooling fluid to the condenser.

The liquid refrigerant delivered to the evaporator 38 may absorb heat from another cooling fluid, which may or may not be the same cooling fluid used in the condenser 34. The liquid refrigerant in the evaporator 38 may undergo a phase change from the liquid refrigerant to a refrigerant vapor. As shown in the illustrated embodiment of FIG. 3, the evaporator 38 may include a tube bundle 58 having a supply line 60S and a return line 60R connected to a cooling load 62. The cooling fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. The evaporator 38 may reduce the temperature of the cooling fluid in the tube bundle 58 via thermal heat transfer with the refrigerant. The tube bundle 58 in the evaporator 38 may include multiple tubes and/or multiple tube bundles. In any case, the vapor refrigerant exits the evaporator 38 and returns to the compressor 32 by a suction line to complete the cycle.

Figure 4:
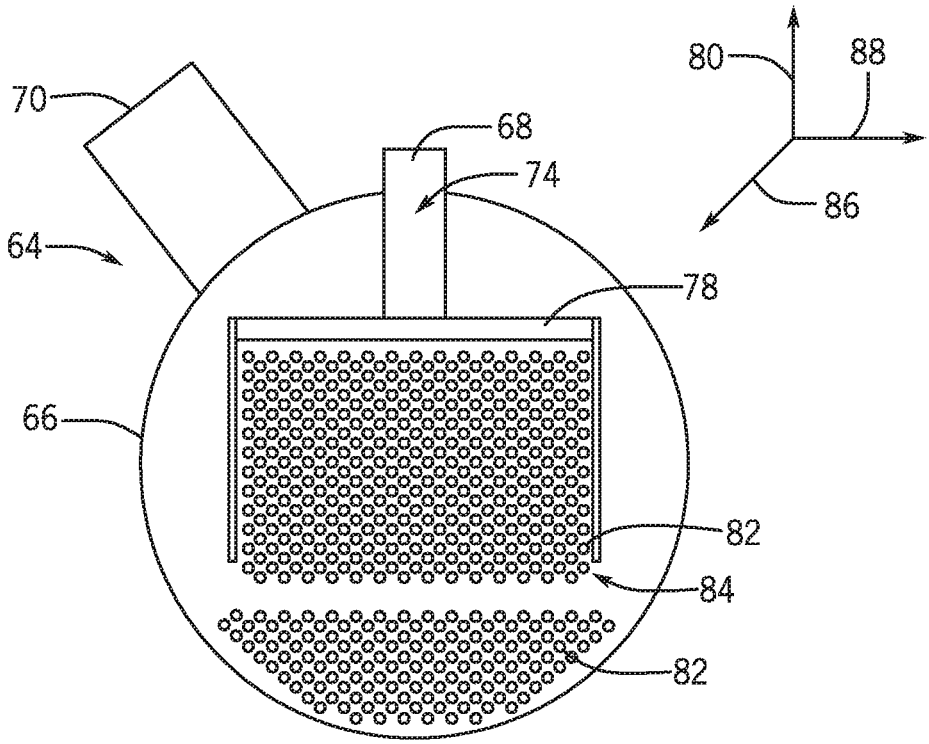
FIG. 4 is a schematic diagram of an embodiment of a falling film evaporator that may be used in a vapor compression system, in which the falling film evaporator includes a refrigerant distributor.

FIG. 4 is a schematic diagram of an embodiment of a falling film evaporator 64 (e.g., falling film heat exchanger) that may be used in a vapor compression system. For example, the falling film evaporator 64 may be used in place of the expansion device and the evaporator of the vapor compression systems of FIGS. 2 and 3. In the illustrated embodiment, the falling film evaporator 64 includes a shell 66 having an inlet 68 and an outlet 70. The inlet 68 is configured to be fluidly coupled to a discharge port of a condenser (e.g., via a discharge passage), and the outlet 70 is configured to be fluidly coupled to a suction port of a compressor (e.g., via a suction line). The inlet 68 is configured to receive refrigerant from the discharge port of the condenser, and the outlet 70 is configured to output the refrigerant to the suction port of the compressor. In the illustrated embodiment, the shell 66 has a substantially circular cross-section. However, it should be appreciated that in alternative embodiments, the shell may have other cross-sectional shapes, such as elliptical or polygonal, among others.

In the illustrated embodiment, the falling film evaporator 64 includes a liquid refrigerant region 74 extending from the inlet 68 to a refrigerant distributor 78 disposed within the shell 66. The liquid refrigerant region 74 is positioned above the refrigerant distributor 78 along a vertical axis 80, and evaporating tubes 82 are positioned below the refrigerant distributor 78 along the vertical axis 80. As illustrated, the evaporating tubes 82 are positioned within an evaporator region 84 of the shell 66. The refrigerant distributor 78 extends along a longitudinal axis 86 and along a lateral axis 88. In the illustrated embodiment, the longitudinal axis 86 corresponds to the direction of extension of the evaporating tubes 82 (e.g., the orientation of the longitudinal axes of the evaporating tubes). Accordingly, the evaporating tubes 82 extend along the longitudinal axis 86.

During operation of the vapor compression system, liquid refrigerant from the condenser enters the shell 66 through the inlet 68. The liquid refrigerant then flows through the refrigerant distributor 78, which distributes liquid refrigerant droplets to the evaporating tubes 82. Contact between the liquid refrigerant droplets and the evaporating tubes 82 induces the liquid droplets to vaporize, thereby absorbing heat from the cooling fluid within the evaporating tubes. As a result, the temperature of the cooling fluid within the evaporating tubes is reduced. The vaporized refrigerant flows from the evaporator region 84 to the outlet 70 and then to the suction port of the compressor (e.g., via a suction line). The refrigerant distributor 78 also establishes a pressure differential between the liquid refrigerant region 74 and the evaporator region 84 sufficient to facilitate efficient evaporation of the refrigerant in the evaporator region.

Figure 5:
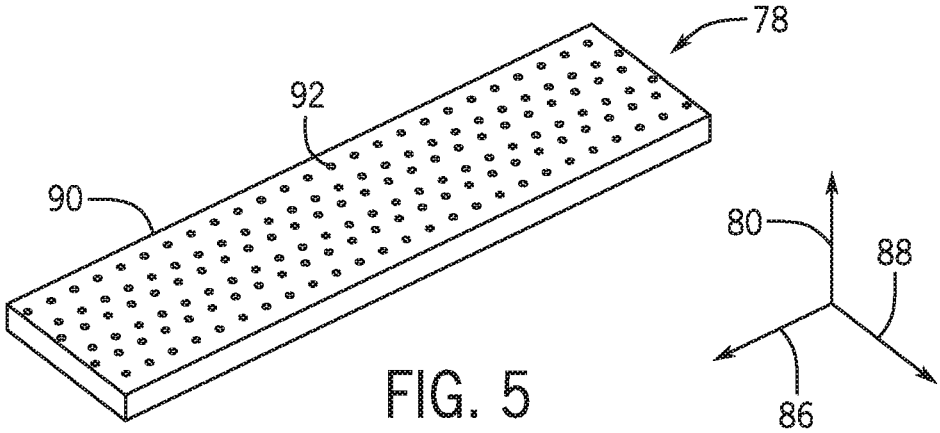
FIG. 5 is a perspective view of an embodiment of a perforated plate that may be used in the refrigerant distributor of FIG. 4.

FIG. 5 is a perspective view of an embodiment of a perforated plate 90 that may be used in the refrigerant distributor of FIG. 4. In the illustrated embodiment, the perforated plate 90 includes multiple holes 92. As discussed in detail below, each hole 92 extends from a top surface of the perforated plate 90 to a bottom surface of the perforated plate 90, thereby enabling the refrigerant to flow through the perforated plate. The holes may be arranged in any suitable pattern to control refrigerant flow through the perforated plate. In addition, the size of the holes and/or the number of holes may be particularly selected to control droplet formation and/or the pressure differential between the liquid refrigerant region and the evaporator region of the falling film evaporator.

Figure 6:
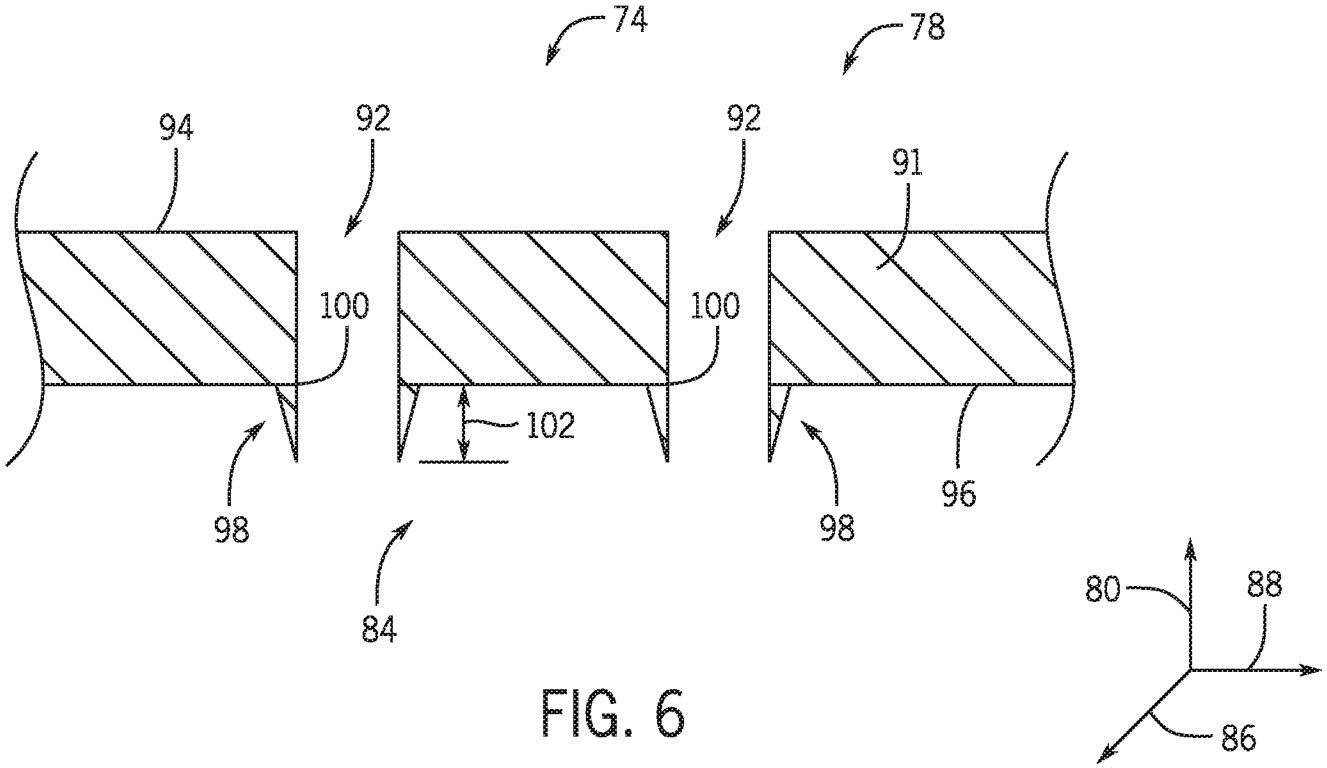
FIG. 6 is a detailed cross-sectional view of an embodiment of a perforated plate that may be used in the refrigerant distributor of FIG. 4.

FIG. 6 is a detailed cross-sectional view of an embodiment of a perforated plate 91 that may be used in the refrigerant distributor 78 of FIG. 4. As illustrated, the perforated plate 91 includes multiple holes 92 that facilitate flow of refrigerant from the liquid refrigerant region to the evaporator region. Each hole 92 extends along the vertical axis 80 from a top surface 94 of the perforated plate 91 to a bottom surface 96 of the perforated plate 91. In the illustrated embodiment, the perforated plate includes protrusions 98 extending from the bottom surface 96 of the perforated plate 91. As illustrated, each protrusion 98 is positioned at an outlet 100 of a respective hole 92. The protrusions 98 are configured to induce the refrigerant flowing through the holes 92 to form droplets, which then fall downwardly under the influence of gravity into the evaporator region.

A height 102 of each protrusion 98 may be particularly selected to establish a target droplet size. In addition, a profile (e.g., shape) of each protrusion may be particularly configured to establish a target droplet size. For example, in certain embodiments, the protrusion may extend about an entire periphery (e.g., circumference) of the hole outlet. However, in alternative embodiments, the protrusion may extend about a portion of the periphery (e.g., about 5 percent to about 95 percent, about 10 percent to about 91 percent, about 20 percent to about 80 percent, about 30 percent to about 70 percent, or about 40 percent to about 60 percent, etc.), and/or multiple protrusions may be positioned at the outlet of at least one hole. In certain embodiments, at least one protrusion may be positioned at the outlet of each hole. However, in alternative embodiments, protrusion(s) may be positioned at a portion of the hole outlets. Furthermore, in certain embodiments, the heights and/or profiles of the protrusions may be substantially the same as one another, or at least a portion of the protrusions may have different heights and/or profiles.

In certain embodiments, the holes and the protrusions may be formed by a stamping process. For example, during the stamping process, projections of a die may engage a solid plate, thereby displacing material of the solid plate to form the holes. The projections may be particularly configured such that the displaced material forms the protrusions on the bottom surface of the plate. For example, the shape and/or configuration of each projection may be particularly selected such that a respective protrusion having a target height and/or profile is formed. In certain embodiments, the protrusions may be further shaped by post-stamping process (es), such as grinding and/or trimming, among others. In further embodiments, the protrusions may be formed separately and coupled to the bottom surface of the perforated plate (e.g., by welding, by adhesively bonding, etc.). It should be appreciated that the protrusions may be employed on any of the embodiments disclosed herein, or the protrusions may be omitted.

Figure 7:
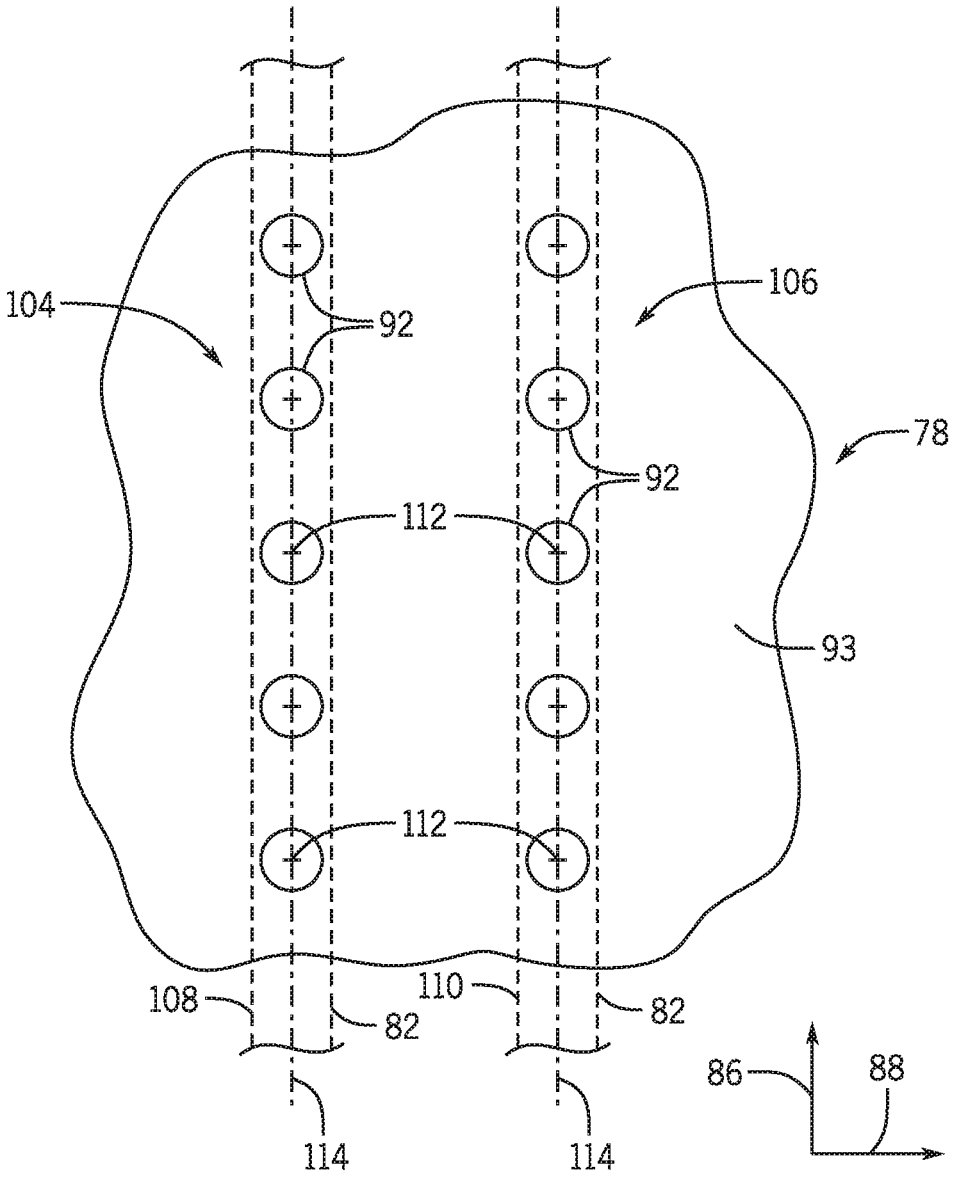
FIG. 7 is a top view of an embodiment of a perforated plate that may be used in the refrigerant distributor of FIG. 4.

FIG. 7 is a top view of an embodiment of a perforated plate 93 that may be used in the refrigerant distributor 78 of FIG. 4. In the illustrated embodiment, the holes 92 are arranged in a first row 104 and a second row 106. As illustrated, the first row 104 is aligned (e.g., substantially aligned) with a corresponding first evaporating tube 108, and the second row 106 is aligned (e.g., substantially aligned) with a corresponding second evaporating tube 108. In addition, a center point 112 of each hole 92 is aligned (e.g., substantially aligned) with a centerline 114 of a respective evaporating tube 82. As illustrated, the center point 112 of each hole 92 of the first row 104 is aligned (e.g., substantially aligned) with the centerline 114 of the first evaporating tube 108, and the center point 112 of each hole 92 of the second row 106 is aligned (e.g., substantially aligned) with the centerline 114 of the second evaporating tube 110. Because the center point of each hole is aligned (e.g., substantially aligned) with the centerline of a respective evaporating tube, the liquid droplet formed by the refrigerant flow through the hole may impact the center of the tube. As a result, the quantity of liquid refrigerant that engages the surface of the respective tube may be increased, as compared to a liquid droplet that impacts a side of the tube (e.g., offset from the center), thereby increasing the efficiency of the evaporation process.

As used herein, aligned and substantially aligned refer to alignment along the lateral axis 88 within an offset tolerance. For example, the offset tolerance may be between about 0.1 mm and about 5 mm, between about 0.2 mm and about 2 mm, or between about 0.5 mm and about 1 mm. By way of further example, the offset tolerance may be between about 0.5 percent and about 5 percent, between about 1 percent and about 4 percent, or between about 2 percent and about 3 percent of the lateral extent (e.g., diameter) of the respective hole. In the illustrated embodiment, the evaporating tubes and the rows of holes extend along the longitudinal axis 86. However, it should be appreciated that in alternative embodiments, the evaporating tubes and the rows of holes may be angled relative to the longitudinal axis. Furthermore, while two rows of holes are shown in the illustrated embodiment, it should be appreciated that the perforated plate may include more or fewer rows of holes (e.g., 1, 2, 3, 4, 5, 6, 7, 8, 9, 10, or more). Furthermore, it should be appreciated that one or more evaporating tubes may be positioned between adjacent rows of holes along the lateral axis 88. In certain embodiments, each row of holes may be aligned with a respective evaporating tube of the top row of the evaporating tube bundle (e.g., the row of evaporating tubes positioned closest to the perforated plate). However, it should be appreciated that in alternative embodiments, one or more rows of holes may be aligned with respective evaporating tube(s) of a lower row (e.g., the second row, the third row, etc.) of the evaporating tube bundle. It should be appreciated that the hole/evaporating tube alignment may be utilized on any of the embodiments disclosed herein, or at least a portion of the holes may not be aligned with the respective evaporating tube(s).

Figure 8:
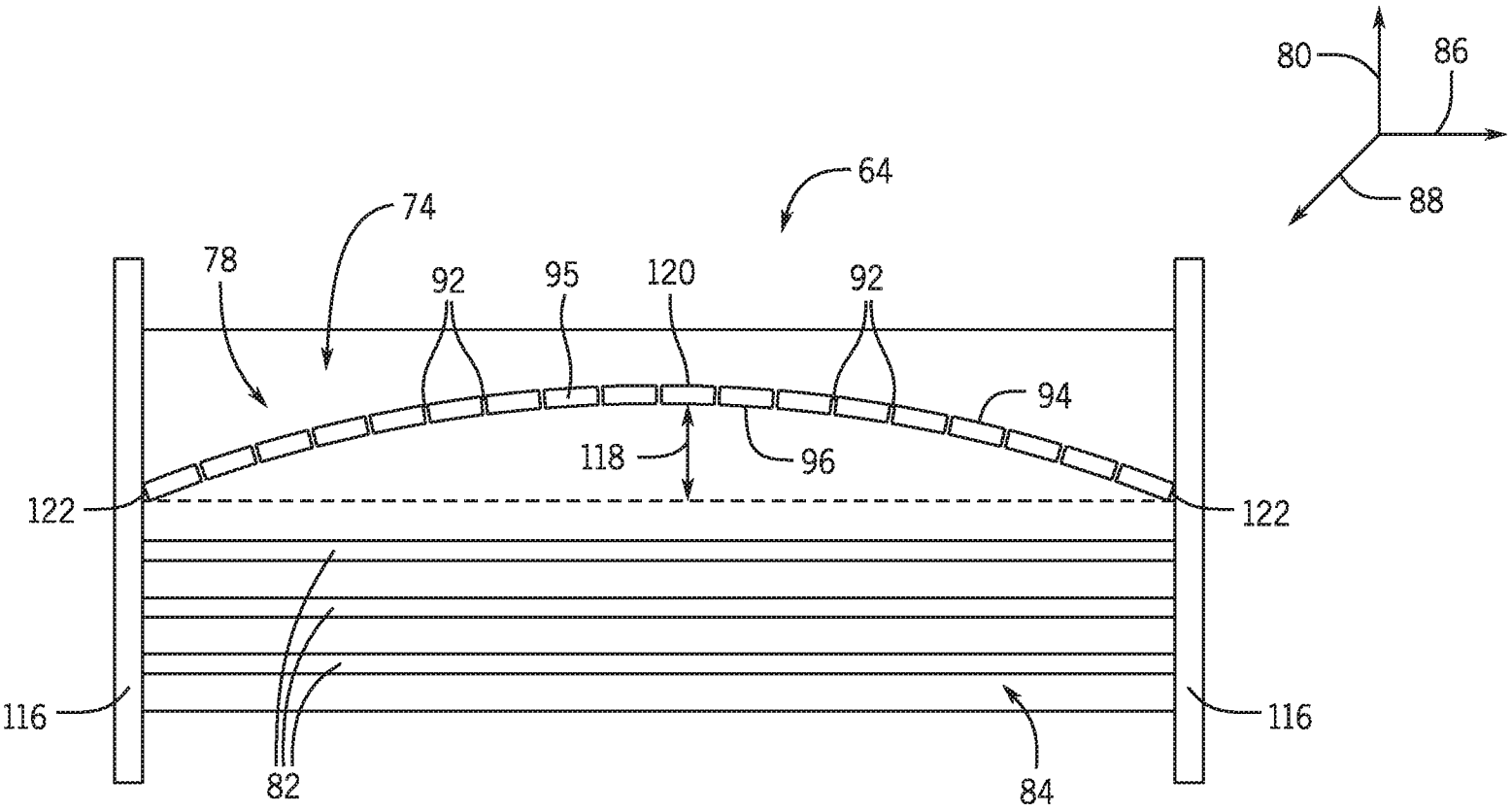
FIG. 8 is a schematic diagram of a portion of an embodiment of a falling film evaporator that may be used in the HVAC&R system of FIG. 1.

FIG. 8 is a schematic diagram of a portion of an embodiment of a falling film evaporator 64. In the illustrated embodiment, multiple evaporating tubes 82 extend along the longitudinal axis 86. While three evaporating tubes 82 are shown in the illustrated embodiment, it should be appreciated that the falling film evaporator may include more (e.g., significantly more) evaporating tubes in certain embodiments. As illustrated, the evaporating tubes 82 are supported by a pair of tube sheets 116, in which each tube sheet 116 extends along the vertical axis 80 and along the lateral axis 88. While the illustrated embodiment includes two tube sheets 116, it should be appreciated that in alternative embodiments, the heat exchanger may include more or fewer tube sheets.

In the illustrated embodiment, the perforated plate 95 of the refrigerant distributor 78 is positioned above the evaporating tubes 82 along the vertical axis 80. The perforated plate 95 includes multiple holes 92 configured to facilitate flow of the refrigerant from the liquid refrigerant region 74 to the evaporator region 84. As illustrated, each hole 92 extends substantially along the vertical axis 80. As used herein, substantially along the vertical axis refers to an angle of about 0 degrees to about 45 degrees, about 0 degrees to about 30 degrees, about 0 degrees to about 20 degrees, or about 0 degrees to about 15 degrees relative to the vertical axis 80. In the illustrated embodiment, the perforated plate 95 is curved (e.g., arcuate) to establish a substantially even distribution of refrigerant across the top surface 94 of the perforated plate 95. For example, refrigerant may be directed toward a central region of the perforated plate (e.g., via a refrigerant header), and the refrigerant may flow to the distal ends of the plate under the influence of gravity, thereby substantially evenly distributing the refrigerant across the perforated plate.

The perforated plate 95 may be particularly configured to control the flow of refrigerant across the top surface 94. For example, a height 118 of a maximum vertical extent 120 of the perforated plate 95 relative to a minimum vertical extent 122 of the perforated plate 95 along the vertical axis 80 may be particularly selected to control refrigerant distribution. While the perforated plate 95 forms a single continuous arc in the illustrated embodiment, it should be appreciated that in alternative embodiments, the perforated plate may form other suitable shapes. For example, in certain embodiments, the perforated plate may form substantially linear segments between the longitudinal center of the perforated plate (e.g., at the maximum vertical extent of the perforated plate) and the distal ends of the perforated plate (e.g., at the minimum vertical extent of the perforated plate). In addition, the perforated plate may include multiple curved and/or linear segments to establish a desired shape/profile. For example, in embodiments in which refrigerant is directed toward multiple longitudinal positions along the perforated plate, the perforated plate may include a peak at each longitudinal position.

While the illustrated perforated plate 95 includes a shaped/profiled top surface 94 and a shaped/profiled bottom surface 96, it should be appreciated that in alternative embodiments, the bottom surface of the perforated plate may be substantially flat, and the refrigerant distribution may be controlled by the shape/profile of the top surface. Furthermore, in certain embodiments, the shape/profile of the perforated plate (e.g., the shape/profile of the top surface of the perforated plate) may extend along the longitudinal axis and along the lateral axis of the heat exchanger. For example, the perforated plate (e.g., the top surface of the perforated plate) may form an arc along the longitudinal axis and an arc along the lateral axis. Moreover, the shape/profile of the perforated plate (e.g., the shape/profile of the top surface of the perforated plate) along the longitudinal axis may be different than the shape/profile of the perforated plate (e.g., the shape/profile of the top surface of the perforated plate) along the lateral axis. For example, the shape/profile of the perforated plate (e.g., the shape/profile of the top surface of the perforated plate) may be substantially constant along one axis (e.g., the lateral axis) and arcuate along the other axis (e.g., the longitudinal axis). It should be appreciated that the shaped/profiled perforated plate (e.g., the shaped/profiled top surface of the perforated plate) may be utilized on any of the embodiments disclosed herein, or the perforated plate (e.g., the top surface of the perforated plate) may be substantially flat.

Figure 9:
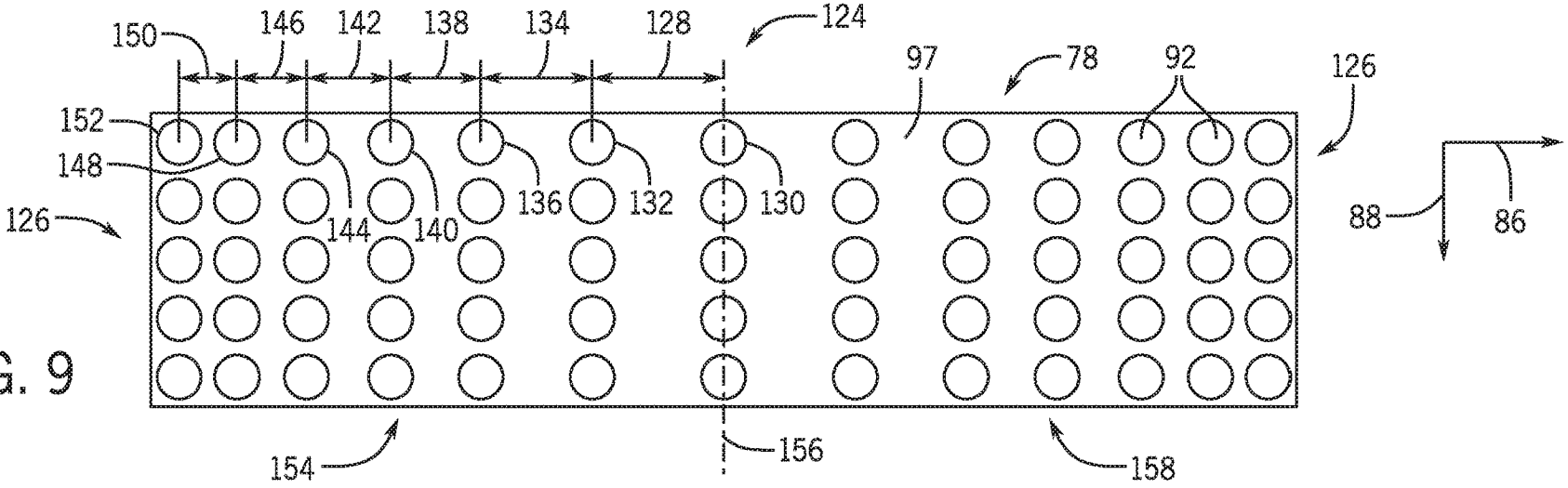
FIG. 9 is a top view of another embodiment of a perforated plate that may be used in the refrigerant distributor of FIG. 4.

FIG. 9 is a top view of another embodiment of a perforated plate 97 that may be used in the refrigerant distributor 78 of FIG. 4. In the illustrated embodiment, the holes 92 are arranged in five rows, and each row extends along the longitudinal axis 86. In certain embodiments, each row may be aligned (e.g., substantially aligned) with a respective evaporating tube, such that the center point of each hole is aligned (e.g., substantially aligned) with the centerline of the respective evaporating tube. While the holes 92 are arranged in five rows in the illustrated embodiment, it should be appreciated that the holes may be arranged in more or fewer rows in alternative embodiments.

In the illustrated embodiment, the spacings between adjacent holes 92 of each row varies along the longitudinal axis 86. As illustrated, the spacings between adjacent holes 92 of each row decreases along the longitudinal axis 86 from a central portion 124 to each distal portion 126 of the perforated plate 97. In the illustrated embodiment, each row includes seven holes 92 between the central portion 124 and each distal portion 126. However, it should be appreciated that each row may include more or fewer holes in alternative embodiments. As illustrated, a first spacing 128 along the longitudinal axis 86 between a first hole 130 and a second hole 132 is greater than a second spacing 134 along the longitudinal axis 86 between the second hole 132 and a third hole 136. In addition, the second spacing 134 is greater than a third spacing 138 along the longitudinal axis 86 between the third hole 136 and a fourth hole 140. Furthermore, the third spacing 138 is greater than a fourth spacing 142 along the longitudinal axis 86 between the fourth hole 140 and a fifth hole 144. The fourth spacing 142 is greater than a fifth spacing 146 along the longitudinal axis 86 between the fifth hole 144 and a sixth hole 148. In addition, the fifth spacing 146 is greater than a sixth spacing 150 along the longitudinal axis 86 between the sixth hole 148 and a seventh hole 152. The decreasing spacing along the longitudinal axis between the central portion and each distal portion may establish a substantially even distribution of refrigerant across the top surface of the perforated plate. For example, refrigerant may be directed toward the central portion of the perforated plate (e.g., via a refrigerant header), and the refrigerant may flow to the distal portions of the perforated plate. As the refrigerant flows from the central portion to the distal portions, a portion of the refrigerant may flow through the holes proximate to the central portion, thereby reducing the quantity of refrigerant that reaches the distal portions. Accordingly, the wider hole spacing proximate to the central portion induces more refrigerant to flow toward the distal portions, as compared to a perforated plate with evenly spaced holes along the longitudinal axis. As a result, the refrigerant may be substantially evenly distributed across the perforated plate.

In the illustrated embodiment, the spacing pattern on a first side 154 of a lateral centerline 156 of the perforated plate 97 is symmetrical with the spacing pattern on a second side 158 of the lateral centerline 156. However, it should be appreciated that the spacing patterns on the sides of the lateral centerline may be asymmetrical in alternative embodiments. Furthermore, while the spacing patterns of the rows are substantially the same as one another in the illustrated embodiment, it should be appreciated that in alternative embodiments, at least one row may have a different spacing pattern. In addition, while the hole spacing decreases between each pair of adjacent holes along the longitudinal axis between the central portion and each distal portion in the illustrated embodiment, it should be appreciated that in alternative embodiments, different spacing pattern(s) may be utilized to control the refrigerant flow across the perforated plate (e.g., based on the longitudinal location(s) at which refrigerant is directed toward the perforated plate). For example, in certain embodiments, the hole spacings between certain pairs of adjacent holes in a row may be substantially equal to one another, and/or the hole spacings between certain pairs of adjacent holes in a row may increase along the longitudinal axis between the central portion and at least one distal portion. It should be appreciated that the variations in hole spacing may be utilized on any of the perforated plate embodiments disclosed herein, or at least a portion of the holes within a perforated plate may have substantially equal spacing along the longitudinal axis.

Figure 10:
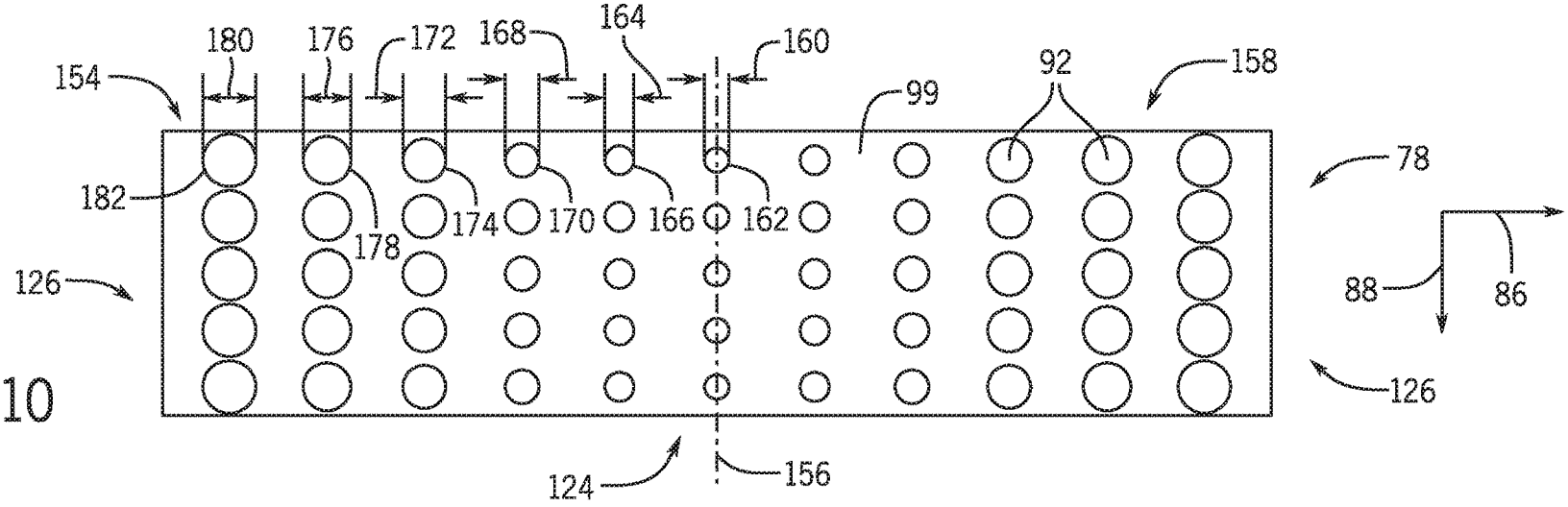
FIG. 10 is a top view of a further embodiment of a perforated plate that may be used in the refrigerant distributor of FIG. 4.

FIG. 10 is a top view of a further embodiment of a perforated plate 99 that may be used in the refrigerant distributor 78 of FIG. 4. In the illustrated embodiment, the holes 92 are arranged in five rows, and each row extends along the longitudinal axis 86. In certain embodiments, each row may be aligned (e.g., substantially aligned) with a respective evaporating tube, such that the center point of each hole is aligned (e.g., substantially aligned) with the centerline of the respective evaporating tube. While the holes 92 are arranged in five rows in the illustrated embodiment, it should be appreciated that the holes may be arranged in more or fewer rows in alternative embodiments.

In the illustrated embodiment, the sizes of adjacent holes 92 of each row vary along the longitudinal axis 86. As illustrated, the sizes of adjacent holes 92 of each row increase along the longitudinal axis 86 from the central portion 124 to each distal portion 126 of the perforated plate 99. In the illustrated embodiment, each row includes six holes 92 between the central portion 124 and each distal portion 126. However, it should be appreciated that each row may include more or fewer holes in alternative embodiments. As illustrated, a first size (e.g., first diameter 160) of a first hole 162 is less than a second size (e.g., second diameter 164) of a second hole 166. In addition, the second size (e.g., second diameter 164) of the second hole 166 is less than a third size (e.g., third diameter 168) of a third hole 170. Furthermore, the third size (e.g., third diameter 168) of the third hole 170 is less than a fourth size (e.g., fourth diameter 172) of a fourth hole 174. The fourth size (e.g., fourth diameter 172) of the fourth hole 174 is less than a fifth size (e.g., fifth diameter 176) of a fifth hole 178. Furthermore, the fifth size (e.g., fifth diameter 176) of the fifth hole 178 is less than a sixth size (e.g., sixth diameter 180) of a sixth hole 182. The increasing sizes of the holes along the longitudinal axis between the central portion and each distal portion may establish a substantially even distribution of refrigerant across the top surface of the perforated plate. For example, refrigerant may be directed toward the central portion of the perforated plate (e.g., via a refrigerant header), and the refrigerant may flow to the distal portions of the perforated plate. As the refrigerant flows from the central portion to the distal portions, a portion of the refrigerant may flow through the holes proximate to the central portion, thereby reducing the quantity of refrigerant that reaches the distal portions. Accordingly, the small holes proximate to the central portion induce more refrigerant to flow toward the distal portions, as compared to a perforated plate with equally sized holes along the longitudinal axis. As a result, the refrigerant may be substantially evenly distributed across the perforated plate.

In the illustrated embodiment, the hole size pattern on the first side 154 of the lateral centerline 156 of the perforated plate 99 is symmetrical with the hole size pattern on the second side 158 of the lateral centerline 156. However, it should be appreciated that the hole size patterns on the sides of the lateral centerline may be asymmetrical in alternative embodiments. Furthermore, while the hole size patterns of the rows are substantially the same as one another in the illustrated embodiment, it should be appreciated that in alternative embodiments, at least one row may have a different hole size pattern. In addition, while the size of each hole increases along the longitudinal axis between the central portion and each distal portion in the illustrated embodiment, it should be appreciated that in alternative embodiments, different hole size pattern(s) may be utilized to control the refrigerant flow across the perforated plate (e.g., based on the longitudinal location(s) at which refrigerant is directed toward the perforated plate). For example, in certain embodiments, the sizes of certain adjacent holes in a row may be substantially equal to one another, and/or the hole size may decrease between certain adjacent holes in a row along the longitudinal axis between the central portion and at least one distal portion. It should be appreciated that the variation in hole sizes may be utilized on any of the perforated plate embodiments disclosed herein (e.g., the variation in hole sizes may be combined with the variation in hole spacing), or at least a portion of the holes within a perforated plate may have substantially equal hole sizes along the longitudinal axis.

Figure 11:
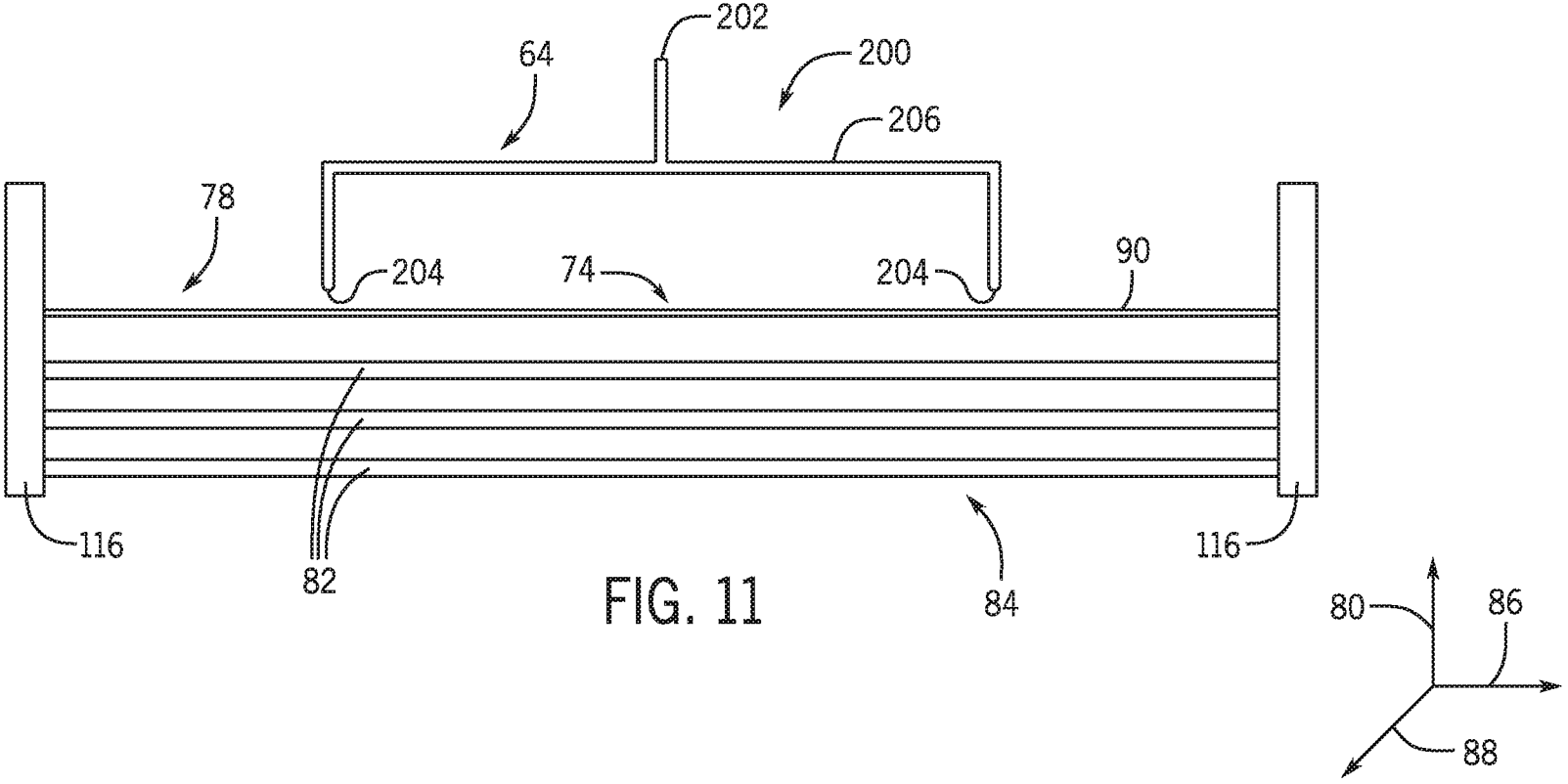
FIG. 11 is a schematic diagram of a portion of an embodiment of a falling film evaporator that may be used in the HVAC&R system of FIG. 1.

FIG. 11 is a schematic diagram of a portion of an embodiment of a falling film evaporator 64 that may be used in the HVAC&R system of FIG. 1. In the illustrated embodiment, the falling film evaporator 64 includes a spray header 200 positioned above the refrigerant distributor 78 within the shell. The spray header 200 is configured to receive refrigerant (e.g., from the inlet of the shell) and to direct the refrigerant toward the refrigerant distributor 78. In the illustrated embodiment, the spray header 200 includes an inlet 202 configured to receive the refrigerant, two spray heads 204 configured to output the refrigerant toward the refrigerant distributor 78, and a manifold 206 configured to direct the refrigerant from the inlet 202 to the spray heads 204. While the illustrated embodiment include two spray heads, it should be appreciated that in alternative embodiments, the spray header may include more or fewer spray heads (e.g., 1, 2, 3, 4, 5, 6, or more).

In the illustrated embodiment, the spray heads 204 extend along the lateral axis 88 substantially perpendicular to the direction of extension of the evaporating tubes 82. As used herein, substantially perpendicular refers to an angle between the spray heads and the evaporating tubes of about 45 degrees to about 135 degrees, about 60 degrees to about 120 degrees, about 75 degrees to about 105 degrees, about 80 degrees to about 100 degrees, or about 90 degrees. Each spray head includes multiple openings distributed along the lateral extent of the spray head (e.g., such that the openings are arranged along the lateral axis). Each opening is configured to output refrigerant toward the refrigerant distributor. Because the openings in the spray header are arranged along the lateral axis, the refrigerant may be distributed more evenly along the lateral axis than heat exchangers having a spray header with openings arranged along the longitudinal axis. Furthermore, in certain embodiments, the refrigerant distributor may include features configured to substantially evenly distribute the refrigerant along the longitudinal axis, such as a shaped/profiled perforated plate, variations in hole spacing within the perforated plate, variations in hole sizes within the perforated plate, or a combination thereof. It should be appreciated that the spray header described above may be utilized with any of the heat exchanger embodiments disclosed herein.

While the embodiments disclosed herein are described with reference to a falling film evaporator, it should be appreciated that certain embodiments disclosed herein (e.g., certain embodiments of the perforated plate) may be employed within other suitable heat exchangers, such as a hybrid falling film heat exchanger (e.g., a falling film heat exchanger with condensing tubes positioned above the perforated plate). Furthermore, while the refrigerant distributors disclosed herein include a single perforated plate, it should be appreciated that in alternative embodiments, the refrigerant distributor may include multiple perforated plates (e.g., an additional perforated plate substantially parallel to the perforated plate disclosed herein). In addition, while the perforated plates disclosed herein include substantially circular holes, it should be appreciated that in alternative embodiments, the holes in the perforated plate may have other suitable shapes, such as elliptical or polygonal, among others.

While only certain features and embodiments have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described (i.e., those unrelated to the presently contemplated best mode of carrying out the disclosure, or those unrelated to enabling the claimed disclosure). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heat exchanger for a heating, ventilation, air conditioning, and refrigeration (HVAC&R) system, comprising:

a shell having an inlet configured to receive refrigerant and an outlet configured to output the refrigerant;

a refrigerant distributor disposed within the shell; and a plurality of evaporating tubes disposed within the shell and positioned below the refrigerant distributor, wherein the refrigerant distributor comprises a perforated plate having a plurality of holes, wherein each hole of the plurality of holes extends from a top surface of the perforated plate to a bottom surface of the perforated plate, and a center point of each hole of the plurality of holes is substantially aligned with a centerline of a respective evaporating tube of the plurality of evaporating tubes, and wherein at least a portion of the top surface is arcuate along a longitudinal axis of the heat exchanger.

2. The heat exchanger of claim 1, wherein at least a portion of the plurality of holes is arranged in a first row, the first row is substantially aligned with a corresponding first evaporating tube of the plurality of evaporating tubes, and the center point of each hole in the first row is substantially aligned with the centerline of the corresponding first evaporating tube.

3. The heat exchanger of claim 2, wherein another portion of the plurality of holes is arranged in a second row, the second row is substantially aligned with a corresponding second evaporating tube of the plurality of evaporating tubes, and the center point of each hole in the second row is substantially aligned with the centerline of the corresponding second evaporating tube.

4. The heat exchanger of claim 1, wherein each hole of the plurality of holes extends substantially along a vertical axis, and a first portion of the perforated plate is positioned above a second portion of the perforated plate along the vertical axis.

5. A heat exchanger for a heating, ventilation, air conditioning, and refrigeration (HVAC&R) system, comprising:

a shell having an inlet configured to receive refrigerant and an outlet configured to output the refrigerant;

a refrigerant distributor disposed within the shell; and a plurality of evaporating tubes disposed within the shell and positioned below the refrigerant distributor, wherein the refrigerant distributor comprises a perforated plate having a plurality of holes each extending substantially along a vertical axis, wherein each hole of the plurality of holes extends from a top surface of the perforated plate to a bottom surface of the perforated plate, wherein the top surface comprises an arcuate section that curves along a longitudinal axis of the heat exchanger, and wherein a first portion of the top surface along the arcuate section is positioned above a second portion of the top surface along the arcuate section, with respect to the vertical axis.

6. The heat exchanger of claim 5, wherein the first portion comprises a central portion of the top surface of the perforated plate, and the second portion comprises a distal portion of the top surface of the perforated plate.

7. The heat exchanger of claim 5, comprising a spray header disposed within the shell and positioned above the refrigerant distributor, wherein each evaporating tube of the plurality of evaporating tubes extends along the longitudinal axis, the spray header has a plurality of openings configured to output the refrigerant toward the refrigerant distributor, and the plurality of openings is arranged along a lateral axis, substantially perpendicular to the longitudinal axis.

8. The heat exchanger of claim 5, wherein a protrusion extends from the bottom surface of the perforated plate toward the plurality of evaporating tubes at a hole outlet of one of the plurality of holes.

9. A heat exchanger for a heating, ventilation, air conditioning, and refrigeration (HVAC&R) system, comprising:

a shell having an inlet configured to receive refrigerant and an outlet configured to output the refrigerant;

a refrigerant distributor disposed within the shell;

a spray header disposed within the shell and positioned above the refrigerant distributor; and a plurality of evaporating tubes disposed within the shell and positioned below the refrigerant distributor, wherein each evaporating tube of the plurality of evaporating tubes extends along a longitudinal axis, wherein the refrigerant distributor comprises a perforated plate having a plurality of holes, wherein each hole of the plurality of holes extends through a thickness of the perforated plate from a top surface of the perforated plate to a bottom surface of the perforated plate, wherein the plurality of holes is arranged in at least one row and configured to drip the refrigerant from the bottom surface directly onto the plurality of evaporating tubes, wherein spacings between adjacent holes of the at least one row vary along the longitudinal axis, sizes of the adjacent holes of the at least one row vary along the longitudinal axis, or a combination thereof, and wherein the spray header is configured to spray the refrigerant directly onto the top surface of the perforated plate and toward a central portion of the perforated plate.

10. The heat exchanger of claim 9, wherein the spacings between the adjacent holes of the at least one row decrease along the longitudinal axis from the central portion of the perforated plate to a distal portion of the perforated plate.

11. The heat exchanger of claim 9, wherein the sizes of the adjacent holes of the at least one row increase along the longitudinal axis from the central portion of the perforated plate to a distal portion of the perforated plate.

12. The heat exchanger of claim 9, wherein each hole of the plurality of holes extends substantially along a vertical axis, and a first portion of the top surface is positioned above a second portion of the top surface along the vertical axis.

13. The heat exchanger of claim 9, wherein a protrusion extends from the bottom surface of the perforated plate toward the plurality of evaporating tubes at a hole outlet of one of the plurality of holes.

14. The heat exchanger of claim 9, wherein the spray header comprises a first spray head and a second spray head disposed within the shell and positioned above the refrigerant distributor, wherein the first spray head and the second spray head are offset from one another along the longitudinal axis and are offset from the central portion of the perforated plate along the longitudinal axis, and wherein the first spray head and the second spray head are configured to discharge the refrigerant toward the central portion.

15. The heat exchanger of claim 14, wherein the plurality of holes is a plurality of first holes, the at least one row is a first row, the spacings are first spacings, the sizes are first sizes, the perforated plate comprises a plurality of second holes arranged in a second row and configured to drip the refrigerant from the bottom surface directly onto the plurality of evaporating tubes, and wherein:

the first spacings between adjacent first holes of the first row vary along the longitudinal axis from the central portion to a first distal end of the perforated plate, the first sizes of the adjacent first holes of the first row vary along the longitudinal axis from the central portion to the first distal end of the perforated plate, or a combination thereof, and second spacings between adjacent second holes of the second row vary along the longitudinal axis from the central portion to a second distal end of the perforated plate, opposite the first distal end, second sizes of the adjacent second holes of the second row vary along the longitudinal axis from the central portion to the second distal end of the perforated plate, or a combination thereof.

16. A heat exchanger for a heating, ventilation, air conditioning, and refrigeration (HVAC&R) system, comprising:

a shell having an inlet configured to receive refrigerant and an outlet configured to output the refrigerant;

a refrigerant distributor disposed within the shell;

a plurality of evaporating tubes disposed within the shell and positioned below the refrigerant distributor, wherein each evaporating tube of the plurality of evaporating tubes extends along a longitudinal axis, and wherein the refrigerant distributor comprises a perforated plate configured to drip the refrigerant onto the plurality of evaporating tubes; and a spray header disposed within the shell and positioned above the refrigerant distributor, wherein the spray header has a plurality of openings configured to output the refrigerant toward the refrigerant distributor, wherein the plurality of openings is arranged along a lateral axis, substantially perpendicular to the longitudinal axis, wherein the spray header comprises:

a manifold configured to direct the refrigerant toward the plurality of openings;

a first spray head extending along the lateral axis, wherein the first spray head is configured to receive the refrigerant from the manifold, the first spray head comprises a first plurality of openings of the plurality of openings, the first plurality of openings is arranged along the lateral axis, and the first plurality of openings is configured to spray the refrigerant directly onto a perforated surface of the perforated plate; and a second spray head extending along the lateral axis, wherein the second spray head is configured to receive the refrigerant from the manifold, the second spray head comprises a second plurality of openings-portion of the plurality of openings, the second plurality of openings is arranged along the lateral axis, and the second plurality of openings is configured to spray the refrigerant directly onto the perforated surface of the perforated plate, wherein the first spray head and the second spray head are offset from a central portion of the perforated plate along the longitudinal axis, and wherein the first spray head and the second spray head are configured to spray the refrigerant toward the central portion of the perforated plate.

17. The heat exchanger of claim 16, wherein the first spray head and the second spray head are spaced completely apart from one another along the longitudinal axis.

18. The heat exchanger of claim 16, wherein the perforated plate comprises a plurality of holes, wherein each hole of the plurality of holes extends from a top surface of the perforated plate to a bottom surface of the perforated plate.

19. The heat exchanger of claim 18, wherein a center point of each hole of the plurality of holes is substantially aligned with a centerline of a respective evaporating tube of the plurality of evaporating tubes.

20. The heat exchanger of claim 18, wherein the plurality of holes is arranged in at least one row, spacings between adjacent pairs of holes of the at least one row vary along the longitudinal axis, sizes of the plurality of holes of the at least one row vary along the longitudinal axis, or a combination thereof.

* * * * *